United States Patent [19]

Guhde et al.

[11] 4,263,059

[45] Apr. 21, 1981

[54] COATING SOLUTIONS OF TRIVALENT CHROMIUM FOR COATING ZINC AND CADMIUM SURFACES

[75] Inventors: Donald J. Guhde, Euclid; Dale M. Burdt, North Olmsted, both of Ohio

[73] Assignee: Rohco, Inc., Cleveland, Ohio

[21] Appl. No.: 106,093

[22] Filed: Dec. 21, 1979

[51] Int. Cl.[3] ..... C23F 7/26

[52] U.S. Cl. ..... 148/6.2; 106/302; 148/6.21; 423/596; 427/383.7; 427/405

[58] Field of Search ..... 148/6.2, 6.21; 106/302, 106/14.13, 14.14, 14.21; 427/388.2, 372.2, 383.7, 386, 419.2, 405; 423/596

[56] References Cited

U.S. PATENT DOCUMENTS

| | | | |
|---|---|---|---|
| 3,535,168 | 10/1970 | Thompson | 148/6.2 X |
| 3,932,198 | 1/1976 | Schneider | 148/6.2 |
| 4,067,747 | 1/1978 | Mansmann et al. | 106/302 |
| 4,141,758 | 2/1979 | Glassman et al. | 148/6.2 |
| 4,171,231 | 10/1979 | Bishop et al. | 148/6.21 |

*Primary Examiner*—Ronald H. Smith
*Assistant Examiner*—Thurman K. Page
*Attorney, Agent, or Firm*—Maky, Renner, Otto & Boisselle

[57] ABSTRACT

Aqueous acidic chromate coating solutions are described for treating zinc, zinc alloy, or cadmium surfaces comprising trivalent chromium as substantially the only chromium ion present, fluoride ion and an acid, the trivalent chromium ions comprising a mixture of green and blue trivalent chromium. One method of preparing the green trivalent chromium is by reducing an aqueous solution of hexavalent chromium with sufficient reducing agent to reduce all of the hexavalent chromium to trivalent chromium. The blue trivalent chromium can be prepared by reducing hexavalent chromium with reducing agent and adding an acid and fluoride ion ($pH<1$). Chromate coatings on zinc, zinc alloy and cadmium surfaces are produced by contacting said surfaces with an aqueous acidic solution of the invention.

15 Claims, No Drawings

COATING SOLUTIONS OF TRIVALENT CHROMIUM FOR COATING ZINC AND CADMIUM SURFACES

BACKGROUND OF THE INVENTION

This invention relates to coating solutions containing trivalent chromium for treating zinc, zinc alloy and cadmium surfaces, and more particularly, to new acidic coating solutions comprising a mixture of green and blue trivalent chromium ion solutions. The invention also relates to a method for depositing chromate coatings on zinc, zinc alloy and cadmium surfaces and to metal articles having zinc, zinc alloy or cadmium surfaces which are chromate coated.

Various conversion coatings on metal surfaces have been suggested in the prior art for the purpose of forming a coating which protects the metal against corrosion and also serves as a base for improving the adhesion of subsequently applied siccative organic finishes. Such conversion coatings are applied by treatment of the surfaces with solutions of various chemicals which react with the surface to form the desired coating. Among the commonly used conversion coating compositions are aqueous phosphate and chromate solutions. Among the simplest of the phosphate compositions are the so-called iron phosphates which comprise, for example, solutions of alkali metal phosphates, and which react with the iron on the metal surface to form an iron phosphate coating.

It also has long been known that surfaces of zinc and zinc-based alloys can be protected against corrosion by treatment with an acid solution containing hexavalent chromium. It was suggested that the attack of the solution on the surface was facilitated if the solution initially contained a small amount of traivalent chromium, and it has been proposed to introduce this trivalent chromium by adding a compound of trivalent chromium, or preferably by adding a small amount of a suitable reducing agent. As the solutions are used, more trivalent chromium is formed by reduction of hexavalent chromium at the zinc surfaces so that the concentration of trivalent chromium progressively increases and the solution eventually has to be discarded when the quality of the coating is affected by the deterioration of the solution. Examples of patents which describe solutions containing mixtures of trivalent chromium and hexavalent chromium include U.S. Pat. Nos. 3,880,772; 3,795,549; 3,553,034; 3,404,046; 3,090,710; 2,911,332; and 2,902,392.

The treatment of zinc surfaces with solutions wherein chromium is entirely in a trivalent state is disclosed in, for example, U.S. Pat. Nos. 3,932,198; 3,647,569; 3,501,352; and 2,559,878. Trivalent chromium solutions also are disclosed in British Pat. No. 1,461,244.

The prior art chromium solutions and the coatings obtained therefrom have not been entirely satisfactory in that they have not always been able to meet the requirements of the zinc plating industry. One of the important requirements of the chromium-containing solution is the ability of the solution to impart a clear to light blue finish on the metal surface. In the past, the achievement of this finish on zinc plated from a cyanide containing solution was a relatively easy process using conventional chromates containing hexavalent chromium compounds sometimes in combination with other species such as nitrates, fluorides, sulfates, etc. However, with the advent of alkaline non-cyanide type zinc plating solutions, the production of the proper finish of the zinc after chromating has been a difficult procedure. The difficulties generally have been thought to result from the co-deposition and inclusion of relatively large amounts of organic materials from the zinc brightener components.

Another problem area in chromating is that of iron contamination of the plating bath which causes black staining of the zinc plate when chromated. This problem frequently is encountered in alkaline non-cyanide baths that have been converted from cyanide containing baths. Cyanide baths generally contain relatively large amounts of complexed iron in the form of ferrocyanides. When the free cyanide concentration of the bath reaches approximately zero, these ferrocyanides begin to decompose during electrolysis, and iron is codeposited in the zinc deposit. This problem also can occur in non-cyanide zinc baths which utilize strong chelating or complexing agents as part of the additive system. The source of iron in this case generally is from drag-in of dissolved iron from the preceding acid pickling tanks. The iron staining problem is most frequently encountered in acid zinc plating baths where the pH is low enough that iron can be dissolved in the bath either from non-plated areas of the parts being processed or from parts laying in the bottom of the plating tank. The generally accepted explanation for the black staining is that the hexavalent chromium compounds used in conventional chromates react with codeposited iron to form black iron oxides.

Another disadvantage of hexavalent chromium type solutions is in the area of waste disposal. Recent emphasis on water pollution problems has drawn attention to the fact that chromates are serious pollutants. In order to satisfy water quality standards, it frequently is necessary to subject the waste water to a multi-stage purification sequence in order to remove chromates from the effluents. Typical steps in the sequence include the reduction of any hexavalent chromium to trivalent chromium and precipitation with, for example, lime. This precipitation results in a reduction in the chromate content of the effluent water but the process is quite expensive.

Another problem which has been observed with chromate finishes which have been described previously is the unacceptable adhesion characteristics when certain paints have been applied over the chromate coatings, particularly on exposure to salt spray.

Chromate coating solutions containing trivalent chromium as substantially the only chromium ion present, fluoride ion, an acid other than nitric acid and an oxidizing agent such as an inorganic halate or peroxide have been described in U.S. Pat. No. 4,171,231. Such solutions deposit desirable light to clear blue chromate finishes but it remains desirable to be able to deposit acceptable chromate coatings in the absence of the oxidizing agents in the baths.

SUMMARY OF THE INVENTION

It now has been found that a highly desirable clear to light blue chromate finish on all types of zinc plate and cadmium surfaces which imparts superior corrosion resistance to the surface can be obtained with an aqueous acidic coating solution comprising trivalent chromium as substantially the only chromium ion present, and peroxide or other oxidizing agents are not required. In addition to the trivalent chromium, the bath contains fluoride ion and an acid. The trivalent chromium used to form the bath is a mixture of green and blue trivalent chromium. The green trivalent chromium solution may be prepared by reducing an aqueous solution of hexavalent chromium with sufficient reducing agent to reduce all of the hexavalent chromium to trivalent chromium and adjusting the pH to between 2 to 4. The blue trivalent chromium is prepared by reducing hexavalent chromium with sufficient reducing agent to reduce substantially all of the hexavalent chromium to trivalent chromium and thereafter adding fluoride ion and an acid (pH<1). The aqueous acidic coating solutions of the invention have been found to achieve a satisfactory single dip chromate finish on all types of zinc plate over a wide operating range. Metal articles having zinc, zinc alloy or cadmium surfaces which have been treated with the aqueous acidic coating solutions of the invention exhibit the desired clear to light blue finish and are characterized by superior corrosion resistance.

DESCRIPTION OF THE PREFERRED EMBODIMENTS

The aqueous acidic coating solutions of the invention which are useful for treating a zinc or zinc alloy surface comprise a mixture of trivalent chromium as substantially the only chromium ion present, fluoride ion and an acid. As a source of trivalent chromium solutions, solutions of chromium (III) sulfate or chromium (III) nitrate, for example, may be used, but the preferred trivalent chromium solutions are those prepared by reduction of an aqueous hexavalent chromium-containing solution. Various water-soluble or water-dispersible sources of hexavalent chromium may be used in the preparation of the trivalent chromium solution provided that the anions or cations introduced with the hexavalent chromium do not have a detrimental effect on either the solution itself or on the coated zinc or cadmium surfaces. Examples of hexavalent chromium materials which may be used are chromic acid ($CrO_3$), the alkali metal chromates such as sodium chromate and potassium chromate, the alkali metal dichromates such as sodium dichromate and potassium dichromate, etc.

Methods for reducing hexavalent chromium with organic and inorganic reducing agents are generally known in the art. For example, U.S. Pat. Nos. 3,063,877 and 3,501,352 described methods for reducing chromium trioxide with aldehydes and alcohols such as formaldehyde and butyl alcohol. However, the amount of reducing agent used in accordance with those patents are insufficient for complete reduction of the hexavalent chromium as required in the present invention. Accordingly, the amount of reducing agent used in the present invention is at least the amount required for complete reduction of the hexavalent chromium to trivalent chromium.

Among the suitable inorganic reducing agents are alkali metal iodides, ferrous salts, sulfur dioxide, hydrogen peroxide, and alkali metal sulfites, bisulfites and metabisulfites. The alkali metal bisulfites, and especially sodium and potassium metabisulfite are preferred. As mentioned above, the reducing agents are employed in amounts sufficient to completely reduce hexavalent to trivalent chromium. In general, the amount of sulfite or bisulfite employed is less than 1% excess (by weight) or with the stoichiometric amount required for complete reduction of hexavalent to trivalent chromium. However, an excess of bisulfite is not detrimental to this invention.

A preferred procedure for preparing trivalent chromium solutions which may be used in the preparation of the coating solutions of the invention is described in British Pat. No. 1,461,244 and U.S. Pat. No. 4,171,231. A source of hexavalent chromium such as chromic acid flakes is dissolved in water, and the reducing agent is added slowly to control the heat of the reaction and to maintain the reaction mixture at the desired temperature. Cooling may be required if the addition progresses too rapidly.

The unique feature of the trivalent chromium solutions of this invention is that they are prepared by mixing two different trivalent chromium solutions, namely a green chromium and a blue chromium solution. The green solution preferably is prepared by reducing hexavalent chromium as described above. In another embodiment, the green trivalent chromium solution is prepared from a concentrated solution of trivalent chromium salt such as $Cr_2(SO_4)_3 \times H_2O$ and $Cr(NO_3)_3 \times H_2O$ by adding a base such as sodium hydroxide to raise the pH of the concentrate to about 3–4. The maximum amount of sodium hydroxide required is believed to be about three moles for each mole of chromium (III) sulfate and for every 2 moles of chromium (III) nitrate in the concentrates.

A blue trivalent chromium solution can be prepared by dissolving a source of hexavalent chromium in water and adding reducing agent at a rate sufficient to control the heat of the reaction mixture at the desired temperature to reduce the hexavalent chromium to trivalent chromium and thereafter adding fluoride ion and an acid to reduce the pH to less than 1.

The source of fluoride ion in the blue trivalent chromium solutions of the invention may be any soluble fluoride compound so long as the ions introduced with the fluoride ion are not detrimental to the performance of the solution. Either metal or ammonium fluorides may be used. Typical fluoride materials include hydrofluoric acid, alkali metal fluorides and alkali metal hydrogen fluorides such as sodium fluoride, ammonium fluoride, sodium hydrogen fluoride, ammonium hydrogen fluoride, etc. Since high water-solubility is desired whenever possible, highly soluble fluorides such as the sodium or ammonium bifluorides are preferred.

The acid which is used in the preparation of the blue solutions used in the invention may be an organic acid, mineral acid or mixtures thereof. Examples of useful organic acids include formic acid, acetic acid, and propionic acid. Useful acids also include nitric acid, sulfuric acid, hydrochloric acid, hydrofluoric acid, sulfamic and phosphoric acid. Nitric and sulfuric acids are the preferred acids. Sufficient acid is included in the blue concentrate to reduce the pH to below 2 and preferably below 1.0.

Blue trivalent chromium solution also can be prepared by dissolving trivalent chromium salts such as $Cr_2(SO_4)_3xH_2O$ in water and adding acid and ammonium bifluoride if required to adjust the pH of the concentrate to below 2 and preferably below 1. A blue trivalent chromium nitrate concentrate also can be prepared from chromic acid, hydrogen peroxide and nitric acid. Neutralization with a base results in a green trivalent chromium concentrate.

The chromium solutions of the invention also can contain peroxide compounds such as hydrogen peroxide, organic peroxides such as urea peroxide, or a metal peroxide such as sodium peroxide, potassium peroxide, zinc peroxide, strontium peroxide, barium peroxide or lead peroxide. Generally, hydrogen peroxide is preferred since it does not introduce any extraneous ions which might adversely affect the performance of the coating solution. Also, the peroxide generally is added to the chromium solution just prior to use, and some peroxide can be added to a working solution when needed to control the quantity of the chromate deposit. The peroxide can be present in amounts up to 50 grams per liter of bath.

The aqueous acidic coating solutions of the invention also may contain a small amount of a cationic wetting agent. The presence of such wetting agents improves the stability of the coating solutions and appears to passivate the zinc or zinc alloy surfaces resulting in improved corrosion protection for the chromate-coated surface. The types of cationic wetting agents which preferably are included in the coating solutions of the invention include those derived from aliphatic amines and more particularly a series of amine-based cationic wetting agents available from the Armak Company under the general trade designations "Armohib 25", "Armohib 28" and "Armohib 31".

The aqueous acidic coating solutions of the invention generally will contain from about 0.1 to about 1 gram per liter and preferably from about 0.3 to about 0.7 gram per liter of trivalent chromium ion.

The following examples illustrate the preparation of the aqueous acidic trivalent chromium solutions used in the invention. Unless otherwise indicated all parts and percentages are by weight.

EXAMPLE 1 (Blue Solution)

The solution of this example is prepared by mixing the following ingredients in the amounts and order indicated:

1.1% v/v of a $Cr^{III}$ compound formed by reacting 94 g/l of chromic acid with 86.5 g/l of potassium metabisulfite and 64 g/l of sodium metabisulfite in water;
3 cc/l of 96% sulfuric acid;
3.6 g/l of ammonium bifluoride;
0.25 ml/l of an organic addition agent which is a solution of 32 cc/l of Armohib 25 (amine wetting agent available from Akzona Chemicals) in water.

EXAMPLE 2 (Blue Solution)

The procedure of Example 1 is repeated except that the sulfuric acid is replaced by an equivalent amount of nitric acid (67%).

EXAMPLE 3 (Blue Solution)

To 28.4 parts of water is added 4.2 parts of chromium trioxide and 24.4 parts of a 25% solution of sodium metabisulfite in water while maintaining the temperature at about 125° F. (52° C.). To this solution is added 40 parts of nitric acid (67%) and 3 parts of ammonium bifluoride. A blue trivalent chromium solution results having a pH<1.

EXAMPLE 4 (Green Solution)

A mixture of 71.4 parts of water, 4.2 parts of chromium trioxide and 24.4 parts of a 25% solution of sodium metabisulfite in water is stirred with cooling to maintain the temperature at about 125° F. The resulting solution is a green trivalent chromium solution with a pH of between 3–4.

EXAMPLE 5 (Blue Solution)

A solution is prepared by mixing the following ingredients in the indicated order and amounts:

0.5 g/l of $Cr^{III}$ as contained in an aqueous solution of chromiun (III) sulfate;
3 cc/l of 96% sulfuric acid;
3.6 g/l of ammonium bifluoride;
0.25 ml/l of the organic addition agent of Example 1.

This solution is heated to about 80° C. before being used in order to assure proper hydration of the $Cr^{III}$.

EXAMPLE 6

A solution similar to Example 1 is prepared except that the sulfuric acid is replaced by 4 cc/l of concentrated hydrochloric acid.

EXAMPLE 7

A solution similar to Example 6 is prepared except that the sulfuric acid is replaced by 55 cc/l of 85% phosphoric acid.

EXAMPLE 8

A solution similar to Example 1 is prepared except that the sulfuric acid is replaced by 7 g/l of sulfamic acid.

EXAMPLE 9

A solution similar to Example 1 is prepared except that the organic addition agent comprises 32 cc/l of Armohib 28 in water.

EXAMPLE 10

A solution similar to Example 1 is prepared except that no organic addition agent is included in the solution.

EXAMPLE 11

A solution similar to Example 5 is prepared except that no organic addition agent is included in the solution.

EXAMPLE 12

A solution similar to Example 5 is prepared except that the trivalent chromium source is about 0.5 g/l of chrome (III) in the form of a chrome (III) acetate solution in water.

EXAMPLE 13

A solution similar to Example 1 is prepared except that 0.2% v/v of 35% hydrogen peroxide is included in the solution.

EXAMPLE 14

A solution similar to Example 5 is prepared except that 0.2% v/v of 35% hydrogen peroxide is included in the solution.

The solutions of the invention are prepared by mixing a blue trivalent chromium solution with a green trivalent chromium solution. The amount of the blue and green chromium included in the solution of the invention may be varied over a wide range although the weight ratio of blue to green chromium generally will be between about 1:10 to about 10:1. Although the precise chemical nature of the two chromium forms is not understood it has been found that the properties of coatings deposited from the solutions of the invention, such as corrosion resistance, are improved when compared to the properties of coatings deposited from either the green or blue chromate solutions used alone.

The following examples illustrate the solutions of the invention, and all parts and percentages are by volume.

| | Parts |
|---|---|
| Example A | |
| Solution of Example 3 | 1.5 |
| Solution of Example 4 | 1.5 |
| Water | 97 |
| Example B | |
| Solution of Example e | 10 |
| Solution of Example 4 | 1.5 |
| Water | 88.5 |
| Example C | |
| Solution of Example 3 | 1.5 |
| Solution of Example 4 | 10 |
| Water | 88.5 |

In the coating operation in which the method of this invention is used, the zinc or cadmium surface usually is first cleaned by chemical and/or physical means to remove any grease, dirt or oxides, although such treatments are not always required. After rinsing the surface with water, the surface then is treated with the aqueous acidic coating solutions of the invention. Treatment may be by any of the commonly used techniques such as spraying, brushing, dipping, roller-coating, reverse roller-coating and flow coating. The coating compositions of the invention are particularly useful in a dipping system.

The pH of the coating solutions of the invention during application generally is from about one to about four and preferably between about one to two. The solutions prepared from an already formed trivalent chromium salt (e.g. chromium chloride), or by reduction of hexavalent chromium with certain reducing agents such as sulfur dioxide, are already acidic and result in blue solutions. To produce a green solution it is necessary to adjust the pH of the concentrate by adding an alkaline reagent thereto. Such reagents include ammonium hydroxide, sodium hydroxide, or potassium hydroxide.

The temperature of application of the coating solutions to the metal surface usually is between about 10° to 50° C. and is preferably between about 20°–35° C. When the method of application is by dipping or immersion, a dipping or immersion time of about 10 to about 30 seconds and preferably of about 10 seconds is utilized. If additional time is required in order to obtain the desired finish, this is an indication that the coating composition needs to be replenished with one or more of the ingredients.

Following the chromate treatment, the metal surface may be rinsed with water, usually also at a temperature below about 50° C. and then dried. Drying may be by air-blowing at room temperature or at higher temperatures, usually up to about 65° C.

The conversion coating produced on the zinc and cadmium surfaces in accordance with the method of this invention generally is a clear finish. In addition to furnishing the attractive appearance to the metal, the chromate coatings of the invention provide improved corrosion resistance and paint adhesion.

The following example illustrates the method for coating zinc surfaces with the aqueous acidic compositions of the invention.

Freshly plated zinc panels are immersed in the solution of Example A for about 15 to 30 seconds whereupon a blue color appears on the surface. The panels are removed from the solution, rinsed with water and allowed to dry over a period of 48 hours at room temperature. The dried panels are subjected to a 5% neutral salt spray environment, and are inspected for corrosion.

For comparison purposes the same procedure is carried out on the same type of freshly plated zinc panels using the following coating solutions: the solution of Example 3, and the solution of Example 4. The treated panels are subjected to the same neutral salt spray environment, and after 24 hours the panels are inspected for evidence of corrosion.

The results of the 24 hour salt spray test are summarized in the following table. These results demonstrate the improved corrosion resistance obtained with the solutions of the invention.

| | Salt Spray Corrosion Test Results | |
|---|---|---|
| Bath of | % Heavy Corrosion | % Total Corrosion |
| Example 3 | 15 | 70 |
| Example 4 | 15 | 60 |
| Example A | 10 | 25 |

Similarly good corrosion resistance is obtained when freshly plated zinc panels are coated with the solutions of Examples B or C.

As mentioned earlier, the desirable results which are illustrated above may be obtained with the coating compositions of this invention over all types of zinc plate and over a wide operating range of chromate components. Thus, the coating compositions of the invention are useful over zinc plates deposited by alkaline non-cyanide type zinc plating solutions, alkaline cyanide zinc plating solutions and acid zinc solutions.

After a metal article has been treated in accordance with the method and composition of this invention, it often is preferred to apply an organic coating composition which may be a siccative coating such as a paint, lacquer, varnish, synthetic resin, or enamel, or an electrostatically deposited powder coating. Examples of siccative coatings which may be used are the acrylic, alkyd, epoxy, phenolic, melamine and polyvinyl alcohol resins and paints.

Application of a siccative coating composition can be effected by any of the ordinary techniques such as brushing, spraying, dipping, roller-coating flow-coating, electrostatic or electrophoretic attraction. The coated article is dried in a manner best suited for the siccative coating composition employed such as by air-drying at ambient or elevated temperature, baking in an oven, or baking under infra-red lamps. In most instances, the thickness of the dried film of the siccative organic coating composition will be from about 0.1 to about 10 mils, and more often between 0.3 to about 5 mils.

From the above description, it will be apparent that the advantages which are obtained from this invention include the avoidance of hexavalent chromium as a pollutant in the process effluent, ease of control since the need for addition of components can be determined from visual appearance of the parts, ability to use the same chromium solution over almost all types of zinc plate regardless of method of deposition, consistent reproducability of the finished appearance, good paint adhesion of the treated metal and good corrosion resistance. Moreover, such desirable results are obtained without the need for oxidizing agents such as peroxides.

We claim:

1. An aqueous acidic chromate coating solution for treating a zinc, zinc alloy or cadmium surface comprising trivalent chromium as substantially the only chromium ion present, fluoride ion and an acid wherein said coating solution is prepared by mixing a green trivalent chromium ion solution with a blue trivalent chromium ion solution having a pH of less than 1 and which comprises trivalent chromium, fluoride ion and an acid.

2. The coating solution of claim 1 wherein the green trivalent chromium ion containing solution is obtained by reduction of a hexavalent chromium-containing solution.

3. The coating solution of claim 1 wherein the solution also contains a peroxide.

4. The coating solution of claim 1 wherein the acid is nitric acid.

5. The coating solution of claim 1 wherein the trivalent chromium ion is obtained by reduction of a hexavalent chromium-containing solution with an alkali metal sulfite or bisulfite.

6. The coating solution of claim 1 wherein the weight ratio of green to blue trivalent chromium ions is within a range of from about 1:10 to about 10:1.

7. The coating solution of claim 1 wherein the solution contains approximately equal amounts by weight of the green and blue trivalent chromium ions.

8. A method of preparing an aqueous acidic chromate coating solution for treating a zinc or zinc alloy surface which comprises the steps of:

(a) preparing a green trivalent chromium ion concentrate by reducing an aqueous solution of hexavalent chromium with sufficient reducing agent to reduce all of the hexavalent chromium to trivalent chromium and raising the pH of the concentrate to between 2 and 4 with a base, (b) preparing a blue concentrate of trivalent chromium by reducing an aqueous solution of hexavalent chromium with sufficient reducing agent to reduce all of the hexavalent chromium to trivalent chromium and mixing the reduced chromium ion-containing solution with a soluble fluoride compound and an acid, and (c) adding a portion of the green concentrate obtained in step (a) to water along with a portion of the blue concentrate obtained in step (b) to form the coating solution.

9. The method of claim 8 wherein the reducing agent is an alkali metal sulfite or bisulfite.

10. The method of claim 8 wherein the acid is a mineral acid.

11. The method of claim 8 wherein the blue trivalent chromium ion solution comprises trivalent chromium, fluoride ion and nitric acid.

12. The method of claim 8 wherein the weight ratio of green to blue trivalent chromium ions is within the range of about 1:10 to 10:1.

13. A method for producing a chromium coating on a zinc, zinc alloy or cadmium surface which comprises the steps of (a) contacting said surface with an aqueous acidic solution comprising trivalent chromium as substantially the only chromium ion present wherein said coating solution is prepared by mixing a green trivalent chromium ion concentrate with a blue trivalent chromium ion concentrate having a pH of less than 1 and comprising trivalent chromium, fluoride ion and an acid, (b) rinsing the surface with water, and (c) drying the surface.

14. A metal article having a zinc, zinc alloy or cadmium surface treated with the aqueous acidic solution of any one of claims 1,2 or 4–7.

15. The method of claim 13 wherein the acidic solution also contains a peroxide.

* * * * *